United States Patent [19]

Grzelka et al.

[11] Patent Number: 4,505,616

[45] Date of Patent: Mar. 19, 1985

[54] SELF-LOCKING CHOCK SYSTEM FOR A JACK-UP RIG UNIT

[75] Inventors: Andrew Grzelka; David R. Hodges, both of Gautier; Lawrence M. Ruckdeschel, Pascagoula, all of Miss.

[73] Assignee: Litton Systems, Inc., Beverly Hills, Calif.

[21] Appl. No.: 498,317

[22] Filed: May 26, 1983

[51] Int. Cl.[3] ..... E02B 17/08

[52] U.S. Cl. ..... 405/198; 254/110; 405/196

[58] Field of Search ..... 405/195-200; 254/89 R, 95, 105, 108, 109, 110, 111; 74/577 M, 575, 533

[56] References Cited

U.S. PATENT DOCUMENTS

| | | | |
|---|---|---|---|
| 103,899 | 6/1870 | Lewis | 405/198 |
| 2,540,679 | 2/1951 | Laffaille | 405/198 X |
| 3,273,859 | 9/1966 | Walli | 254/109 |
| 3,332,663 | 7/1967 | Cargile | 405/198 X |
| 3,570,812 | 3/1971 | Finkbeiner | 254/110 X |
| 4,032,112 | 6/1977 | Schmidt | 254/108 |

*Primary Examiner*—Dennis L. Taylor
*Attorney, Agent, or Firm*—D. J. Ellingsberg

[57] ABSTRACT

The self-locking chock system has a plurality of pawl cams grouped in a sequential alignment along a support member that is substantially parallel with a leg rack of a jack-up rig unit. Each of the cams is pivoted about a pivot axis that is on the common alignment axis of the support member, and is forced to ride upon the leg rack by a center of gravity located outwardly from the alignment axis on the side opposite that which rides on the leg rack. The cam profile is adapted to ride along the leg rack profile when the relative motion between the leg rack and the support member is in a first direction. When the relative motion is in a direction opposite to the first direction, the cam profile complements the leg-rack profile and under the weighted urging of the cam, the cam profile engages the leg-rack profile and enters into a positive, self-locking engagement that restrains further relative motion between the leg rack and the support member at least in the opposite direction.

5 Claims, 2 Drawing Figures

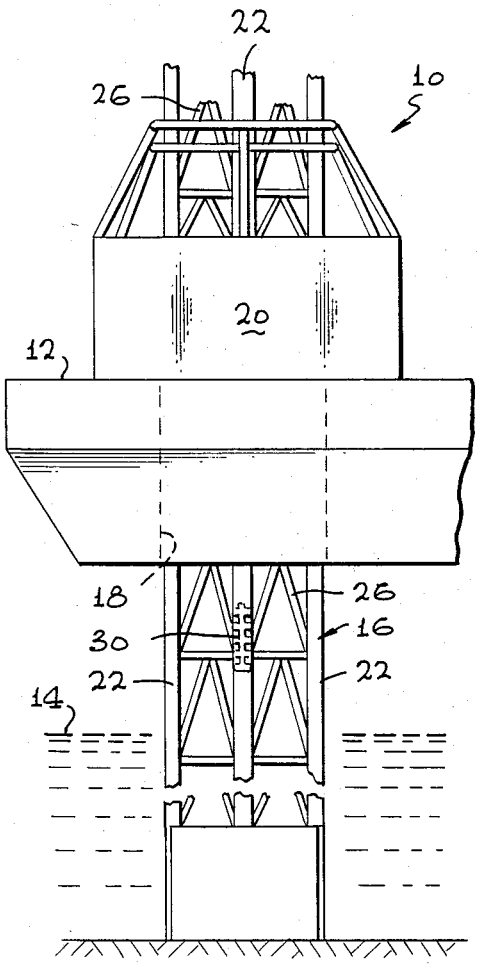
FIG. 1
PRIOR ART
FIG. 2
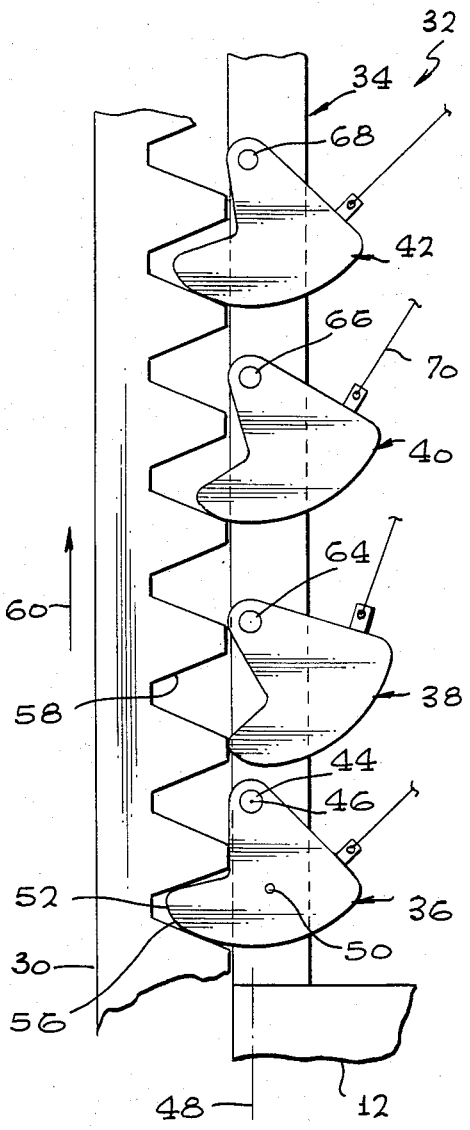

SELF-LOCKING CHOCK SYSTEM FOR A JACK-UP RIG UNIT

TECHNICAL FIELD

A self-locking chock system having a plurality of pawl cams grouped in a series to individually ride upon a rack of a jacking system for a jack-up rig unit, and pivoted to swing into locking engagement with the rack under at least the weight of an individual cam when the rack tooth profile and the cam profile complement each other so that a self-locking engagement is developed between the chock system and the rack.

BACKGROUND ART

A dispositive treatise on jack-up rig units, rack-and-pinion type jacking systems, and rack chocks, including other forms of rack-teeth engaging devices, is available in U.S. Pat. No. 4,269,543 granted May 26, 1981 to J. L. Goldman et al.

The rigidification system of U.S. Pat. No. 4,269,543 includes a three-tooth rack chock element to "interdigitate and mate" with the teeth of the leg rack, yet teaches that the desired rigidification by "one simple tooth is possible." Most leg racks are fabricated by flame cutting which can, and usually does, develop racks that are out-of-tolerance. It is known that available leg racks, because of this imprecise cut, do not have identical tooth profiles and tooth spacing, i.e., pitch. This lack of precision does not affect known jacking systems since the pinion arrangement of such systems accomodates dimensional variations. Such a jacking system (rack-and-pinion type) is taught by U.S. Pat. No. 3,606,251 granted Sept. 20, 1971 to H. L. Willke et al. and reissued Feb. 14, 1978 as U.S. Pat. No. Re. 29,539. However, because of these dimensional variations, it can not be assured that load bearing contact between the rack chock and the leg rack is made with more than one tooth since the rack chock cannot be custom fitted to the leg rack when the relative position of the moveable platform can and does vary over the entire length of the leg rack.

In a best mode of the invention, the self-locking chock system has a plurality of pawl cams grouped in a sequential alignment along a support member that is substantially parallel with a leg rack of a jack-up rig unit. Each of the cams is pivoted about a pivot axis that is on the common alignment axis of the support member, and is forced to ride upon the leg rack by a center of gravity located outwardly from the alignment axis on the side opposite that which rides on the leg rack. The cam profile is adapted to ride along the leg rack profile when the relative motion between the leg rack and the support member is in a first direction. When the relative motion is in a direction opposite to the first direction, the cam profile complements the leg-rack profile and under the weighted urging of the cam, the cam profile engages the leg-rack profile and enters into a positive, self-locking engagement that restrains further relative motion between the leg rack and the support member at least in the opposite direction.

BRIEF DESCRIPTION OF THE DRAWING

The invention is described in detail below with reference to the drawings that includes an illustration of one specific embodiment, in which:

FIG. 1 is an elevation view, partly broken away, of a PRIOR ART jack-up rig unit wherein the invention can find use.

FIG. 2 is an elevation view, partly broken away and sectional, of one specific embodiment of the invention.

BEST MODE OF CARRYING OUT THE INVENTION

An example of one PRIOR ART form of jack-up rig unit 10 is shown by FIG. 1. The rig unit 10 has a working platform 12, which can also function as a vessel hull when it is in physical contact with water 14; for example, when it is floated in the water and moved to a working location. The rig unit 10 has one or more upright leg structures, such as leg structure 16, that extend through a platform opening which is indicated generally at 18 in phantom. A jack house 20 is mounted on the platform 12 above each such leg opening 18. The jack house 20 extends upwardly from the platform and generally encloses the associated leg structure 16.

The leg structure 16 is illustrated as a trussed type formed with three or more chords. One or more, preferably three, identical tubular column members 22 are arranged in a geometric relationship with each of the column members interconnected by horizontal brace members 24 and diagonal, but generally longitudinally extending, brace members 26.

A rack member 30, which can be a dual rack as illustrated by FIGS. 1 and 2, is provided on each of the column members 22 and extends longitudinally along the column member. The rack member 30 is engaged by the jack pinions of a jack (not shown) to move the working platform 12 relative to the leg structure 16; usually to either raise or lower the platform relative to the water surface 14.

When the working platform 12 is at its desired position, the adjustable locking chock system 32 of the invention as shown by FIG. 2 is moved into engagement with the associated rack member 30 and the platform is rigidly locked to the legs 16. This is required for safety.

The self-locking chock system 32 as shown by FIG. 2 has a support member 34 that is carried by the platform 12. A plurality of similar pawl cams, 36, 38, 40 and 42 are carried by the support member 34. Although only four cams are illustrated by FIG. 2, a series of similar cams spaced along the support member 34, or along similar support members is contemplated and preferred so that more than one pawl cam is in a positive, self-locking engagement with the leg rack 30 as will be described; for example, the positive, self-locking engagement of cam 36 of the chock system 32 with the leg rack. The total number of pawl cams that are placed in a similar positive, self-locking engagement will vary according to the load carrying requirements placed on the self-locking chock system of the invention.

Each pawl cam 36, 38, 40 and 42 is structurally identical to the other cams so only the structure of pawl cam 36 will be described for clarity and simplification of description.

Pawl cam 36 is fastened to support member 34 on a shaft 44 that functions as a pivot about which the cam can freely rotate. Shaft 44 has a pivotal axis 46 that is positioned on a longitudinally extending alignment axis 48 of the support member 34. Cam 36 is configured so that its center of gravity, which is symbolically shown at 50, is located outwardly of the alignment axis 48 on the cam side opposite a pawl portion 52 of the cam that engges the leg rack 30. The alignment axis 48 is substantially parallel with the longitudinal axis 54 of the leg rack 30.

The cam profile 56 of the pawl portion 52 of pawl cam 36 permits the cam profile to ride along the toothed profile 58 of the leg rack 30 as the platform 12 is raised so that the relative motion of the platform 12 to the leg rack 30 is in the direction indicated schematically by arrow 60. In the best mode of carrying out the invention, the distances between the center 46 of shaft 44 and the center or pivotal axis of shaft 64, between the pivotal axis of shaft 64 and that of shaft 66, and between the axis of shaft 66 and that of shaft 68 are not necessarily equal but are selected so that more than one cam of the series of cams, such as cam 36 of cams 36, 38, 40, and 42 are in a positive, self-locking engagement with the leg rack 30. It is preferred that at least three pawl cams be so engaged at any given time to share the imposed load.

When the platform 12 is to be lowered so that the relative motion of the platform to the leg rack 30 is in the direction opposite to that of arrow 60 in FIG. 2, each of the pawl cams 36, 38, 40, and 42 are pulled out of contact engagement with the leg rack; for example, by a line 70 attached to each of the cams. Each similar line 70 can be associated with a block-and-tackle, and tied off at the platform 12 when the respective pawl cam is out of contact engagement with the leg rack 30. Release of the line 70 returns the cam to its pivotal, positive, self-locking engagement function.

As will be evidenced from the foregoing description, certain aspects of the invention are not limited to the particular details of construction as illustrated, and it is contemplated that other modifications and applications will occur to those skilled in the art. It is, therefore, intended that the appended claims shall cover such modifications and applications that do not depart from the true spirit and scope of the invention.

We claim:

1. A rack chock system comprising:

(a) a longitudinally extending support member, (b) a plurality of similar cam means grouped in an unevenly spaced apart sequential alignment along said support member, (c) a longitudinally extending rack member separate from and adjacent to said support member, (d) a rack profile on said rack member adapted to contact and selectively engage with said cam means.

(e) each of said cam means having a pivot axis positioned a fixed distance from an adjacent one of said cam means.

(f) each of said cam means movable about said pivot axis to contact and ride along said rack profile where relative motion between said support member and said rack member is in a first direction, and adapted to selectively enter into a locking engagement when relative motion is in a second direction generally opposite to the first direction so that further relative motion therebetween is restricted, and (g) unlocking means to move said cam means out of said locking engagement so that relative motion is permitted between said support member and said rack member.

2. The rack chock system of claim 1 in which each of said cam means has a cam profile portion adapted to ride along said rack profile, and a cam pawl portion adapted to selectively engage said rack profile in said locking engagement.

3. The rack chock system of claim 2 in which each of said cam means has a cam center-of-gravity located to continuously urge both said cam profile portion and said cam pawl portion against said rack profile and selectively into locking engagement with said rack profile, respectively.

4. The rack chock system of claim 1 in which in any group of said cam means at least one of said cam means is positioned for said locking engagement during said relative motion therebetween.

5. In a jack-up unit having a support leg (16) and with a rack (30) connected thereto and disposed generally along a portion of the leg, a platform (12) supported by the leg, and a chock system (32) carried by the platform to selectively lock the leg and the platform together for rigidification of the jack-up unit, a chock system improvement for the jack-up unit characterized by:

(a) a plurality of cams (36,38,40,42) grouped in an unevenly spaced apart sequential alignment along the platform, each of said cams including:

(1) a cam pivot axis (46) for each of said cams, (2) a cam profile portion (56) adapted to ride along the rack profile (58) where relative motion between the platform and the leg rack is in a first direction, (3) a cam pawl portion (52) adapted to selectively engage the rack profile when aligned in a desired locking engagement where relative motion in a second direction generally opposite to the first direction is restricted, and (4) a cam center-of-gravity (50) located to continuously urge both said cam profile portion and said cam pawl portion against the rack profile and into locking engagement, respectively, and (b) a cam unlocking means including:

(1) a block-and-tackle cable (70) connected to each of said cams so that a cam in the desired locking engagement can be moved away from the rack profile by pivoting about said cam pivot axis against the continuous urging of said cam center-of-gravity developed force.

* * * * *